United States Patent [19]

Wright

[11] 4,370,975

[45] Feb. 1, 1983

[54] APPARATUS PROMOTING FLOW OF A BODY FLUID IN A HUMAN LIMB

[76] Inventor: Edward S. Wright, 837 Larchmont Rd., Pittsburgh, Pa. 15243

[21] Appl. No.: 181,712

[22] Filed: Aug. 27, 1980

[51] Int. Cl.[3] ..... A61H 1/00

[52] U.S. Cl. ..... 128/64

[58] Field of Search ..... 128/24 R, DIG. 20, 60, 128/64, 299, 30, 30.2

[56] References Cited

U.S. PATENT DOCUMENTS

| | | | |
|---|---|---|---|
| 2,533,504 | 12/1951 | Poor | 128/24 R |
| 2,781,041 | 2/1957 | Weinberg | 128/24 R |
| 2,893,382 | 7/1959 | Demeny | 128/64 |
| 3,391,692 | 7/1968 | Spielberg | 128/24 R |
| 3,862,629 | 1/1975 | Ratta | 128/24 R |

*Primary Examiner*—Richard C. Pinkham
*Assistant Examiner*—T. Brown
*Attorney, Agent, or Firm*—Carothers and Carothers

[57] ABSTRACT

A double wall sheath for receiving an arm or leg is separated into longitudinally spaced inflatable air cells for encircling the limb. The cells are connected to a source of air pressure by tubes and normally closed valve means that are opened periodically by timing means to inflate the cells and then are closed simultaneously. Pressure regulatory means are connected with the tubes for delivering progressively less air pressure to each successive cell from one end of the sheath to the other to promote flow of body fluid along the limb.

5 Claims, 2 Drawing Figures

APPARATUS PROMOTING FLOW OF A BODY FLUID IN A HUMAN LIMB

In the treatment of certain physical conditions it is desirable to promote the flow of a body fluid along an arm or leg. For example, a physician may want to increase blood circulation in a foot or a hand, or he may wish to promote the flow of lymph toward the heart in the affliction known as Parkes-Weber Syndrome, in which a leg swells to a size much greater than normal size. Currently in use is a double wall sheath or stocking with air pressure introduced between the walls to squeeze the leg. I have found that such a system does not work very well, apparently because the uniform pressure applied throughout the length of the leg tends to cause flow of fluid in the leg in opposite directions and therefore interferes with forward flow. In other words, a back pressure is created that interferes with forward flow from behind the back pressure area. It also has been proposed to enclose an arm or leg in a sheath that is separated into a number of longitudinally spaced inflatable air cells encircling the limb to be treated. These cells are inflated by air pressure successively from one end of the sheath to the other and the constricting cells are supposed to force the fluid in the desired direction in the limb. Such apparatus is shown, for example, in U.S. Pat. Nos. 2,533,504 and 2,781,041. In the patented apparatus each successive cell is subjected to the same air pressure and the pressure is maintained until after all of the cells have been pressurized. Here again the pressure in each cell creates a back pressure in the leg that interferes with the forward flow of fluid from behind it.

It is among the objects of this invention to overcome this disadvantage by substantially eliminating the objectionable back pressure.

DESCRIPTION OF THE PREFERRED EMBODIMENT

Figure 1:
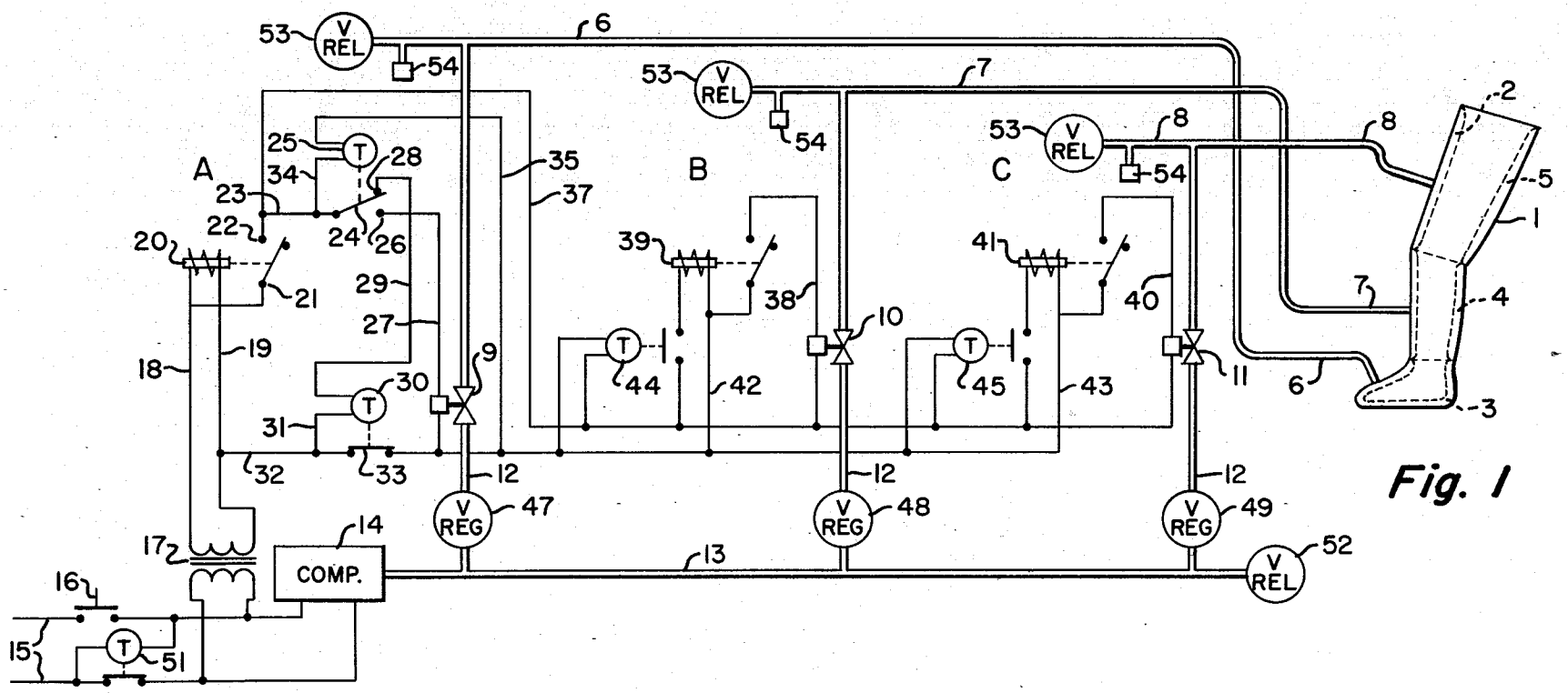
FIG. 1 is a schematic of the preferred embodiment of the invention illustrating the sheath for a human limb connected to the controlled valve system.

The preferred embodiment of the invention is illustrated in the accompanying drawing, which is a diagram of the improved apparatus.

Referring to the drawing, a sheath for a human limb, such as an arm or leg, can take the form of a sleeve open at both ends, a glove that covers the hand and extends up the arm to the shoulder, or, as shown, a boot that covers the foot and calf and thigh of a leg. The boot has a double wall with an air chamber between the walls. The outer wall 1 is relatively inelastic and the inner wall 2 is flexible. At suitable longitudinally spaced intervals the air chamber is separated into separate inflatable cells encircling the inner wall. For example, the bottom cell 3 may enclose the foot, an intermediate cell 4 enclose the calf of the leg and the top cell 5 may enclose the thigh. The outer wall of each cell is provided with an opening connected to one end of an air tube.

The three tubes 6, 7 and 8 connect the air cells with valve means that may be controlled electrically, electronically, pneumatically or in some other way. Preferably, the valve means are electrically operated and are in the form of three-way normally closed solenoid valves 9, 10 and 11. These valves are connected to tubes 12 leading from a manifold 13, to which air under pressure is supplied from a suitable source, such as a compressed air cylinder or an electrically operated compressor 14. When the valves are open, compressed air flows through them to tubes 6, 7 and 8 to press the inner walls of the air cells tightly against the foot and leg. When the valves are closed, they shut off the air flow but connect the three tubes with the atmosphere to release the pressure in the boot. Electric current for the compressor is supplied through wires 15, in one of which there is a manually operated on and off switch 16. Current may also be supplied from these wires to a transformer 17 that will reduce the voltage to 12 volts, for example.

The transformer is connected by wires 18 and 19 to a normally open relay 20, one contact 21 of which is connected to wire 18. The other contact 22 is connected by a wire 23 to one side of a switch 24 forming part of an adjustable electric on-timer 25. This switch, depending on its position, closes one or the other of two different circuits. One circuit has a contact 26 connected by a wire 27 to valve 9. The other circuit has a contact 28 connected by a wire 29 with an adjustable off-timer 30, which is also connected by a wire 31 to a wire 32 leading from wire 19. The normally closed switch 33 operated by this timer is in wire 32 between wire 31 and valve 9. Timer 25 is connected by a wire 34 to wire 23, and by a wire 35 to wire 32 on the valve side of timer switch 33. It will be seen that when the relay and both timer switches are closed, valve 9 will be opened to flow of compressed air through it to boot cell 3.

The other two solenoid valves are connected by a wire 37 to wire 23. Valve 10 also is connected by a wire 38 to one side of a normally open relay 39, and valve 11 is connected by a wire 49 to one side of a normally open relay 41. These two relays are connected by wires 42 and 43 with wire 32. Relay 39 also is connected through a normally open adjustable sequence timer 44, when closed, with wire 37, and relay 41 is connected through another normally open adjustable sequence timer 45 with wire 37.

It is a feature of this invention that in operation less air pressure is supplied to cell 4 than to cell 3, and less pressure is supplied to cell 5 than to cell 4. For this purpose there are pressure regulators 47, 48 and 49 in tubes 12, and the regulators are adjustable to provide the desired air pressure in each cell.

In operation of the system disclosed herein, when the main switch 16 is closed, relay 20 closes, which causes timer 25 to immediately move its movable contact into engagement with contact 26, whereby the circuit to valve 9 is closed and the valve is opened. If the two sequence timers 44 and 45 are set to close at this same time, then the other two relays 39 and 41 will close and valves 10 and 11 will open. In such a case all of these valves will open at the same time and remain open until timer 25 times out and shifts its movable contact from contact 26 to contact 28. This will start timer 30 operating, which will immediately open switch 33 and thereby cut timer 25 and valve 9 out of the circuit for the length of time that timer 30 is set to operate. When timer switch 33 opens, valve 9 returns to closed position and allows air to escape from tube 6 to the atmosphere. Opening of switch 33 will also cut off the current to relays 39 and 41 so that they will open and allow valves 10 and 11 to close. As soon as timer 30 times out, switch 33 will reclose and timer 25 will start operating, which will shift switch 24 back to contact 26 and open all of the valves to repeat the cycle as many times as an adjustable system timer 51 allows.

Preferably, however, the three valves are not opened at the same time as just described, but are opened at spaced intervals so that the pressure inflating cell 3, by constricting the foot, will start fluid flowing up the leg for a predetermined time before cell 4 is pressurized. Likewise inflated cell 4 puts pressure on the leg for a given time before cell 5 is pressurized while pressure is maintained in the first two cells. Consequently, the cells are inflated in succession during each cycle and, due to the different settings of the pressure regulators, the applied pressure is progressively less from the lowest cell 3 to the highest cell 5. This promotes the flow of fluid up through the leg because each cell will force the fluid to an area above it that is under less pressure. The delayed opening of valves 10 and 11 is controlled by the sequence timers 44 and 45, each of which is set to close for a predetermined time after it starts operating.

As one example of the timing of the valve openings and the resulting delivery of different air pressures to the boot, on-timer 25 may be set to run 90 seconds and to time out for 30 seconds before repeating, and pressure regulator 47 is set for an air pressure of 70 mm of mercury to inflate cell 3 of the boot. Sequence timer 44 is set to close 20 seconds after the on-timer starts and to remain closed 70 seconds. Pressure regulator 48 is set for an air pressure of 60 mm of mercury to inflate cell 4. Sequence timer 45 is set to close 40 seconds after the on-timer starts and to remain closed 50 seconds. Pressure regulator 49 is set for an air pressure of 50 mm of mercury to inflate cell 5 of the boot.

Because one cannot be sure that a plurality of timers will all time out at exactly the same time, off-timer 30 is used. When it starts to operate, it opens the circuits to the on-timer and the sequence timers so that all three stop at the same time and close the three valves simultaneously. All timers reset themselves to zero every time their operating electric current is cut off. They are adjustable to provide any desired on and off periods, and of course the pressure regulators can be adjusted for any desired air pressures. Such timers and pressure regulators are conventional items that can be purchased. The use of separate relays 20, 39 and 41 and off-timer 30 can be avoided by employing solid phase electronic timers that can be set for time-off as well as time-on. Such timers can be purchased from the Eagle Signal Division of Gulf and Western Manufacturing Company.

The operation described thus far is suitable for conditions where it is desirable to promote flow of fluid, such as lymph, from the foot or hand toward the heart to reduce swelling. However, the system can be used just as well to increase blood circulation in a limb by promoting flow of blood toward the hand or foot. In such a case, considering a leg, tube 6 would be connected with the upper cell of the boot and tube 8 would be connected with the lowermost cell 3.

Manifold 13 preferably is provided with a pressure relief valve 52, and tubes 6 to 8 are likewise provided with pressure relief valves 53. The tubes may also be connected to pressure switches 54 that can be wired to an alarm that will be activated if the air pressure in the tubes exceeds a desired level.

It will be seen that this apparatus is adjustable in many ways for optimum treatment of the particular physical condition for which it happens to be used. It will also be understood that a sheath is not limited to three air cells, but may have more cells or even only two if desired. The lineal pumping action from a high pressure area to a lower pressure area as produced by this system prevents back flow and should permit the use of lower air pressure than in a uniform pressure system, thereby reducing the risk of tissue damage.

Figure 2:
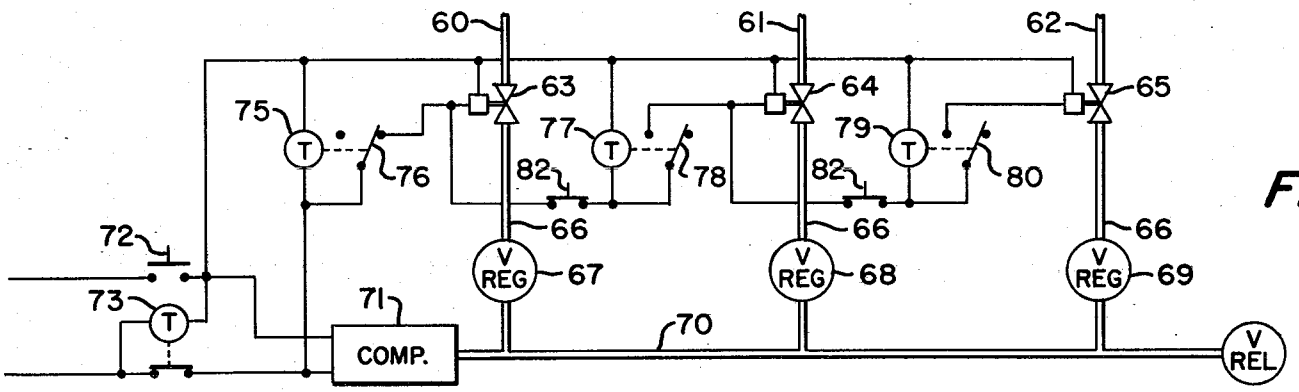
FIG. 2 is a schematic of a modification of the apparatus.

In the modification shown in FIG. 2 the air pressure lines are the same as in FIG. 1. That is, tubes 60, 61 and 62 that are connected to the air cells of a boot or the like, as shown in FIG. 1, lead away from electrically operated valves 63, 64 and 65, respectively, that are connected by tubes 66 and adjustable pressure regulators 67, 68 and 69 to a manifold 70, to which air under pressure is supplied from an electrically operated compressor 71. In the wires leading to the compressor there is an on and off switch 72 and an adjustable timer 73 that will turn off the system after a predetermined time for which the timer is set.

Adjustable timers for opening the valves are the solid phase electronic type previously mentioned herein, but which are illustrated diagrammatically. The first timer 75 has a normally closed switch 76 electrically connected with the first valve 63. This timer is the constantly running type that will keep its switch closed for a predetermined time and then open it for another predetermined period, both periods being adjustable. As soon as the system switch 72 is closed to energize timer 75, valve 63 is opened and the second adjustable timer 77 is energized. This second timer is provided with a normally open switch 78 that does not close until the timer has been operating for a predetermined time, for example, 20 seconds. When switch 78 closes, it not only opens the second valve 64 but it also energizes the third adjustable timer 79, which is the same type as the second one with a normally open switch 80. After this third timer has operated for a predetermined time, its switch will close and thereby open the third valve 65. All three valve timers will now be energized and all three timer switches will remain closed until timer 75 times out. At that moment its switch 76 will open and that will break the circuit to the other two timers 77 and 79 so that their switches likewise will open. Opening of switch 76 also cuts off electric current to all three valves at the same time, thereby permitting them to close and connect tubes 60, 61 and 62 with the atmosphere.

When the first timer 75 times out, it continues to be energized and to hold its switch open for a predetermined off time before it again closes its switch to open the first valve and start the second timer operating. This on and off cycle is repeated as long as the system timer switch is operating. Also, as soon as timer switch 76 is opened to go into the time off period, the other two valve timers automatically reset themselves, ready for the next time that timer switch 76 closes again.

Normally closed manually operable switches 82 are shown in the electric lines to the second and third valve timers so that both of these timers, or only the third timer, can be cut out of the circuit if it is desired to not supply air pressure to one or two of the cells in the boot.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Apparatus for promoting flow of a body fluid from one end of a human limb to the opposite end, comprising a double wall sheath for receiving such a limb, the outer wall of the sheath being relatively inelastic and the inner wall being flexible with an air chamber therebetween, said chamber being separated into a plurality of separate inflatable cells encircling said inner wall with the outer wall of each cell provided with an opening, a source of air under pressure, tubes connecting said source with said openings, a plurality of normally closed valves respectively connected with respective of said tubes for valving the respective tubes open and closed independently, adjustable timing means operatively connected with the valves for opening said valves for independently adjustable periods of time to inflate said cells for independently adjustable periods of time and then releasing the air pressure from all of the cells, and pressure regulating means connected with said tubes for delivering progressively less air pressure to each successive cell from one end of said sheath to the other end.

2. Apparatus according to claim 1, in which said timing means is adapted to open said valves in succession a predetermined time after the preceding valve has been opened, the succession of valve opening corresponding with the progression of air pressure delivery by said pressure regulating means with the valve connected with the cell receiving the most air pressure being the first to open.

3. Apparatus according to claim 2, in which said valves are three-way valves, and said timing means include a separate timer for opening each valve, said valves being formed to release air from said cells to the atmosphere when the valves are closed.

4. Apparatus according to claim 2, in which said timing means include a separate timer for opening each valve, said timers including switches connected in series and operated by the respective timers, whereby when a one of said switches which is associated with the timer that controls the valve connected with the cell receiving the most air pressure is opened, the remaining timers will be opened.

5. Apparatus according to claim 1, in which said pressure regulating means include a separate adjustable pressure reducer for each of said cells, a one of said pressure reducers which is connected with the cell at said one end of said sheath being set for a predetermined air pressure, and each successive pressure reducer being set for less air pressure than the preceding pressure reducer.

* * * * *